US006289784B1

(12) United States Patent
Park et al.

(10) Patent No.: US 6,289,784 B1
(45) Date of Patent: Sep. 18, 2001

(54) PUMP FOR SPRING WATER

(76) Inventors: Kyung-seo Park, 1-602 Lucky Apt., 1257 Kuro-dong, Kuro-gu; Kuk-seo Park, 100-1 Kuro-5-dong, Kuro-gu, both of Seoul (KR), 152-055

( * ) Notice: Subject to any disclaimer, the term of this patent is extended or adjusted under 35 U.S.C. 154(b) by 0 days.

(21) Appl. No.: 09/320,441

(22) Filed: May 27, 1999

(30) Foreign Application Priority Data

Nov. 10, 1998 (KR) ..... 98-47980

(51) Int. Cl.[7] ..... F01B 19/00
(52) U.S. Cl. ..... 92/44; 222/209; 222/400.8
(58) Field of Search ..... 92/44; 417/472; 222/207, 209, 214, 400.8, 383.1

(56) References Cited

U.S. PATENT DOCUMENTS

| | | | | |
|---|---|---|---|---|
| 5,014,881 | | 5/1991 | Andris | 222/207 |
| 5,740,949 | * | 4/1998 | Park | 222/209 |
| 5,829,640 | | 11/1998 | Hershey et al. | 222/153.13 |

* cited by examiner

*Primary Examiner*—Edward K. Look
*Assistant Examiner*—Thomas E. Lazo
(74) *Attorney, Agent, or Firm*—Reed Smith Hazel & Thomas LLP

(57) ABSTRACT

A spring water pump comprising: a housing sealably connected to a water container and having a sealing member for sealing the connected portion between the water container and the housing; a pressure member of bellows type located inside the housing, the pressure member being compressed by an user's pressing action and expanded by its restitutive force; a push cap having an upper portion exposed over the housing and a lower portion positioned on the pressure member, the push cap pressed down by the user's pressing action; a connecting pipe for drawing up spring water from the water container; a discharging pipe for discharging spring water pumped upwardly through the connecting pipe; and guiding means for guiding vertically smooth sliding of the push cap in the housing. By the guiding means, the push cap can smoothly slide in the housing under any pressure condition, and the user can easily push the push cap by small power. Additionally, the spring water pump according to this invention can prevent crush by contact of components and entry of fragments by the crush.

5 Claims, 7 Drawing Sheets

PUMP FOR SPRING WATER

BACKGROUND OF THE INVENTION

1. Field of the Invention

This invention relates to a pump for providing spring water by hand-worked pumping action, and more particularly to, a hand-worked spring water pump which provide a smooth pumping action, prolonged useful life, and reliability of the product.

2. Description of the Prior Art

In general, spring water which is used as drinking water is clearer than tap water and is good for the health. Spring water which is natural water is filled in a water container and provided to general houses.

Spring water put in the water container can be poured into a small vessel such as a cup by using an electric-powered or hand-worked pump so as for an user to easily drink.

The electric pump has a structure that a motor is rotated by electric power from a battery disposed in a housing and an impeller drivingly mounted on a lower end portion of the motor is rotated so that spring water is pumped up from the water container.

The hand-worked pump has a structure that a pumping member of bellows type is repeatedly compressed and expanded by the user's repeatedly pressing action, so that spring water is pumped up by sucking force and discharged from the water container. The hand-worked pump is widely used, because it does not need to change its consumptive articles such as the battery.

The hand-worked pump comprises: a housing sealably connected to a water container and having a sealing member for sealing the connected portion between the water container and the housing; a push cap exposed over the housing and pressed by the user's pressing action; a pressure member of bellows type located inside the housing and being compressed by the user's push cap pressing action and expanded by its elasticity; a connecting pipe having an upper end mounted at the pressure member and a lower end positioned in spring water in the water container, the connecting pipe drawing up spring water by sucking force generated due to difference in the inside air pressure of the water container; a discharging pipe for discharging spring water from the water container through the connecting pipe.

When the pressure member of bellows type exposed over the housing is pressed by the user's push cap pressing action, inside pressure of the water container which keeps equilibrium state with atmospheric pressure by a valve (shown in FIG. 1) is higher than atmospheric pressure because applied air pressure of the pressure member. Therefore, spring water in the water container is discharged through the connecting pipe and the discharging pipe to the outside of low pressure, so that the user can drink spring water from the water container through the discharging pipe.

When the user releases the user's hand from the push cap, the pressure member of bellows type is expanded in virtue of its restitutive force or elasticity of a spring. Air sucking force occurs inside the pressure member due to expansion of the pressure member, and the inside air pressure of the water container becomes low. Therefore, the inside air pressure of the water container is equal to the atmospheric pressure, so that spring water in the water container cannot be discharged any more.

The previously described pumping action is performed by sliding of the push cap exposed over the housing. However, the conventional hand-worked spring water pump does not have guiding means for smoothly sliding the push cap along the inner wall of the housing.

Therefore, the hand-worked pump has a disadvantage that a push cap does not slide in a straight line, but is inclined to one direction in the housing during pumping action.

The hand-worked pump has another disadvantage that the push cap is rotated or twisted, so that the pump cannot provide smooth pumping action.

The hand-worked pump has a further disadvantage that, because the push cap is inclined or twisted during pushing, pressure is dispersed, and the pump requires more pressure to discharge spring water outside, so that the user feels fatigue.

The hand-worked pump has a still further disadvantage that the push cap is contacted with other components of the pump due to forced sliding and inclination of the push cap, so that the contacted portion of the components made of synthetic resin material are crushed.

The hand-worked pump has a still further disadvantage that the crushed fragments are caught between the inner wall of the housing and the push cap to restrain sliding action of the push cap or entered into the water container to pollute spring water in the water container.

SUMMARY OF THE INVENTION

In view of the foregoing, it is accordingly, a primary object of the present invention to provide a spring water pump which has guiding means for preventing inclination of a push cap.

It is also an object of the present invention to provide a spring water pump which allows smooth pumping action for a user to easily push a push cap.

It is a further object of the present invention to provide a spring water pump which prevents crush of components by contacting with each other.

It is a still further object of the present invention to provide a spring water pump which is of a durable and reliable construction.

It is a still further object of the present invention to provide a spring water pump which is sanitary.

The foregoing and other objects and features of the present invention will become more fully apparent to persons of ordinary skill in the art from the following description and appended claims, taken in conjunction with the accompanying drawings.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which.

DETAILED DESCRIPTION OF THE PREFERRED EMBODIMENTS

Figure 1:
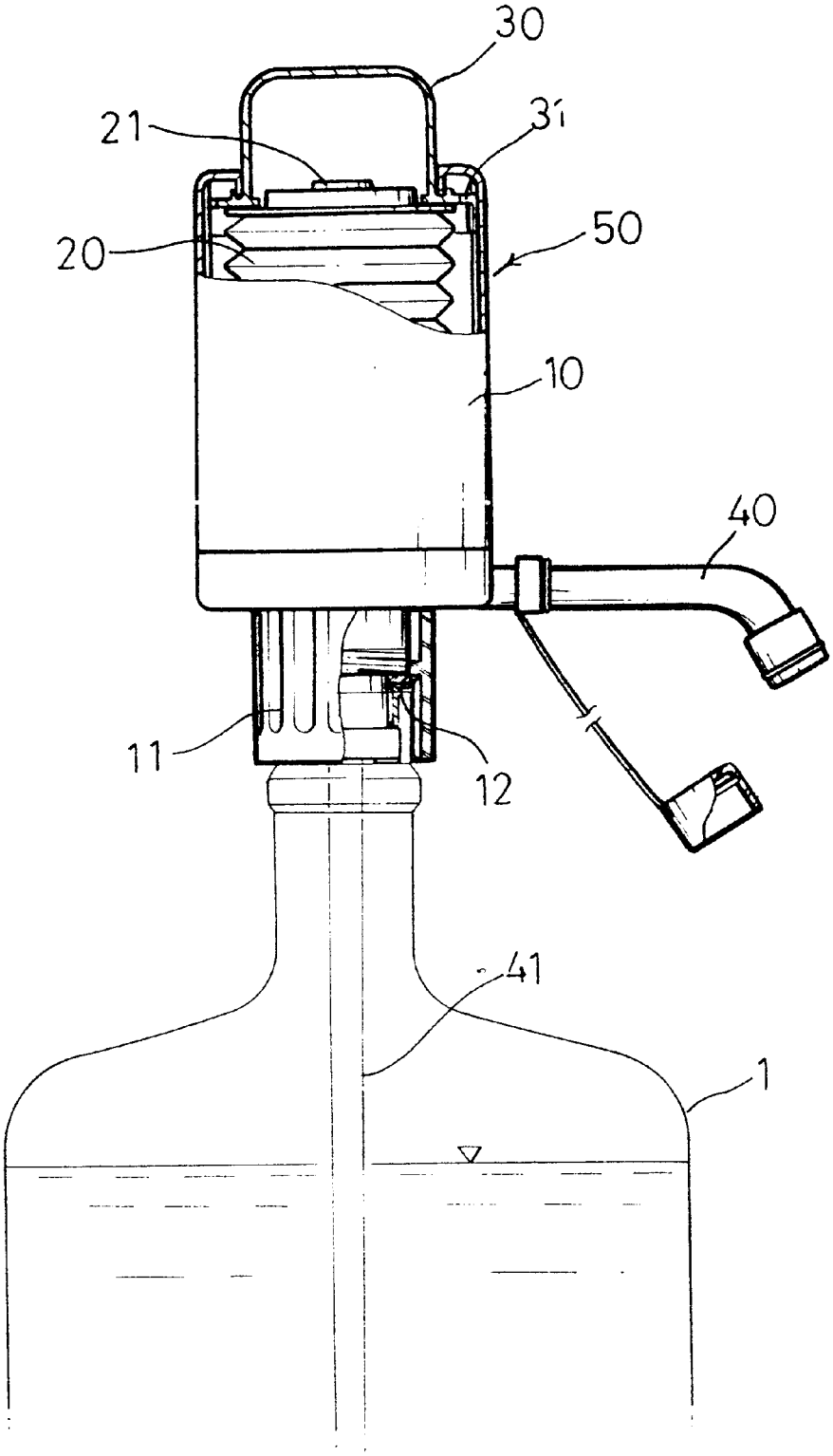
FIG. 1 is a partially cut longitudinal sectional view of the present invention.

Referring now to the drawings, wherein like reference characters designate corresponding parts throughout several views, the reference numeral 1 indicates a spring water container.

A pump for providing spring water according to the present invention includes: a housing 10 sealably connected to the water container and having a sealing member 11 for sealing the connected portion between an inlet of the container 1 and the housing 10; a pressure member 20 of bellows type located inside the housing 10, the pressure member 20 being compressed by an user's pressing action and expanded by its elasticity; a push cap 30 having an upper portion exposed over the housing 10 and a lower portion disposed in the housing 10 and positioned on the pressure member 20, the push cap 30 being pressed down by the user to compress the pressure member 20; a connecting pipe 41 having an upper end mounted at the pressure member 20 and a lower end positioned in spring water in the water container 1, the connecting pipe 41 drawing up spring water by sucking force generated due to difference in the inside air pressure of the water container 1; a discharging pipe 40 for discharging spring water pumped upwardly through the connecting pipe 41 during pumping action; and, guiding means for guiding smooth sliding of the push cap 30 along an inner wall of the housing 10.

The sealing member sealing between the water container 1 and the housing 10 has a packing 12 for preventing entry of extraneous matters and for perfectly sealing the inlet of the water container 1.

Figure 2:
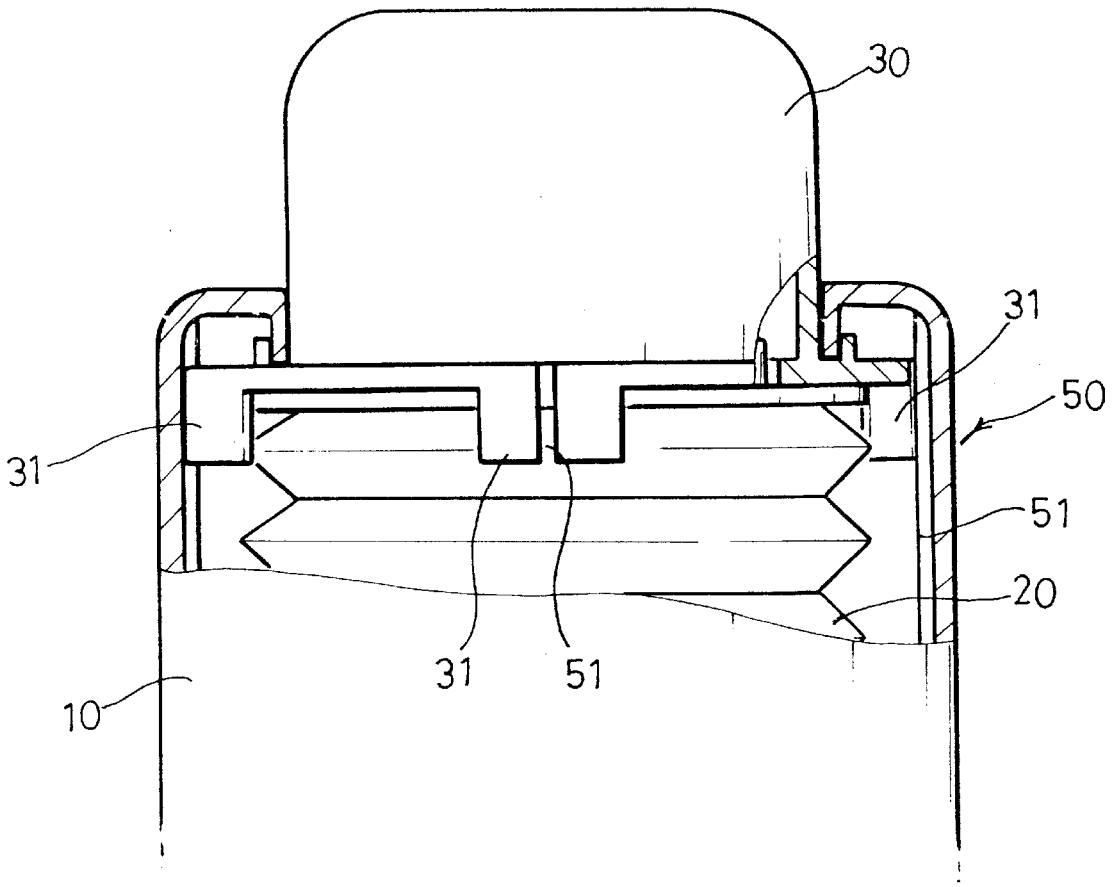
FIG. 2 is a expended sectional view showing components of a pump according to a preferred embodiment of the present invention.

As shown in FIGS. 1 to 2, the pressure member 20 which is positioned in the housing 10 functions as a pumping member, that is, when the user pushes the push cap 30 with hand, the pressure member 20 is compressed by pressure from the push cap 30, and when the user releases the user's hand from the push cap 30, the pressure member 20 is expanded by its restitutive force.

The pressure member 20 of bellows type is hollow and has a valve 21 at an upper portion thereof, so as to control flow of pressure. Additionally, it is preferable that a spring (not shown in drawings) is mounted in the pressure member 20 to have more excellent restitutive force.

The process that spring water in the container 1 is discharged through a connecting pipe 41 and the discharging pipe 40 to the outside by the pumping action is as in the prior arts. Therefore, description of the water discharging process is omitted.

Figure 3:
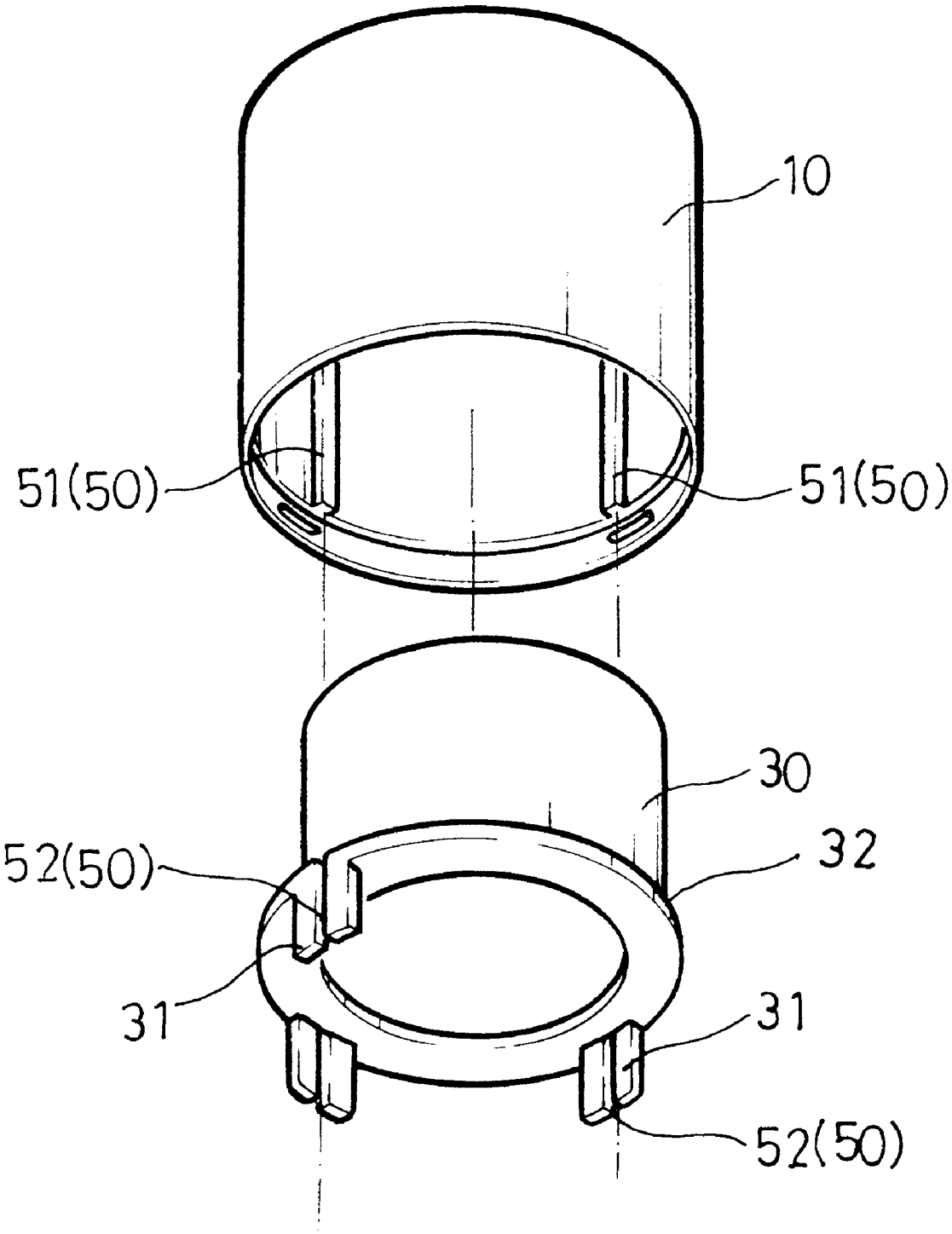
FIGS. 3 to 6 are exploded perspective views showing modified embodiments of pumping guiding means.
Figure 4:
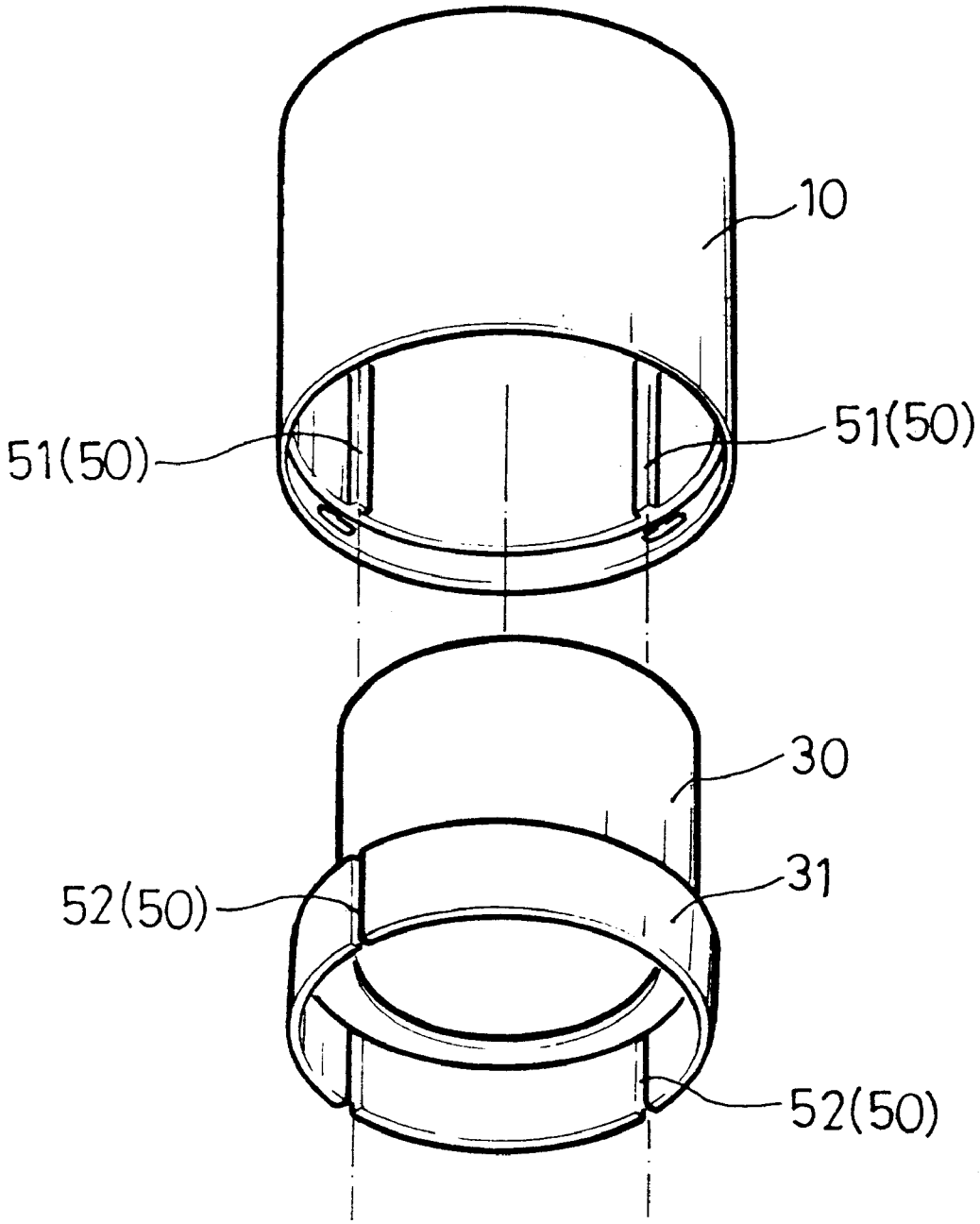
Figure 5:
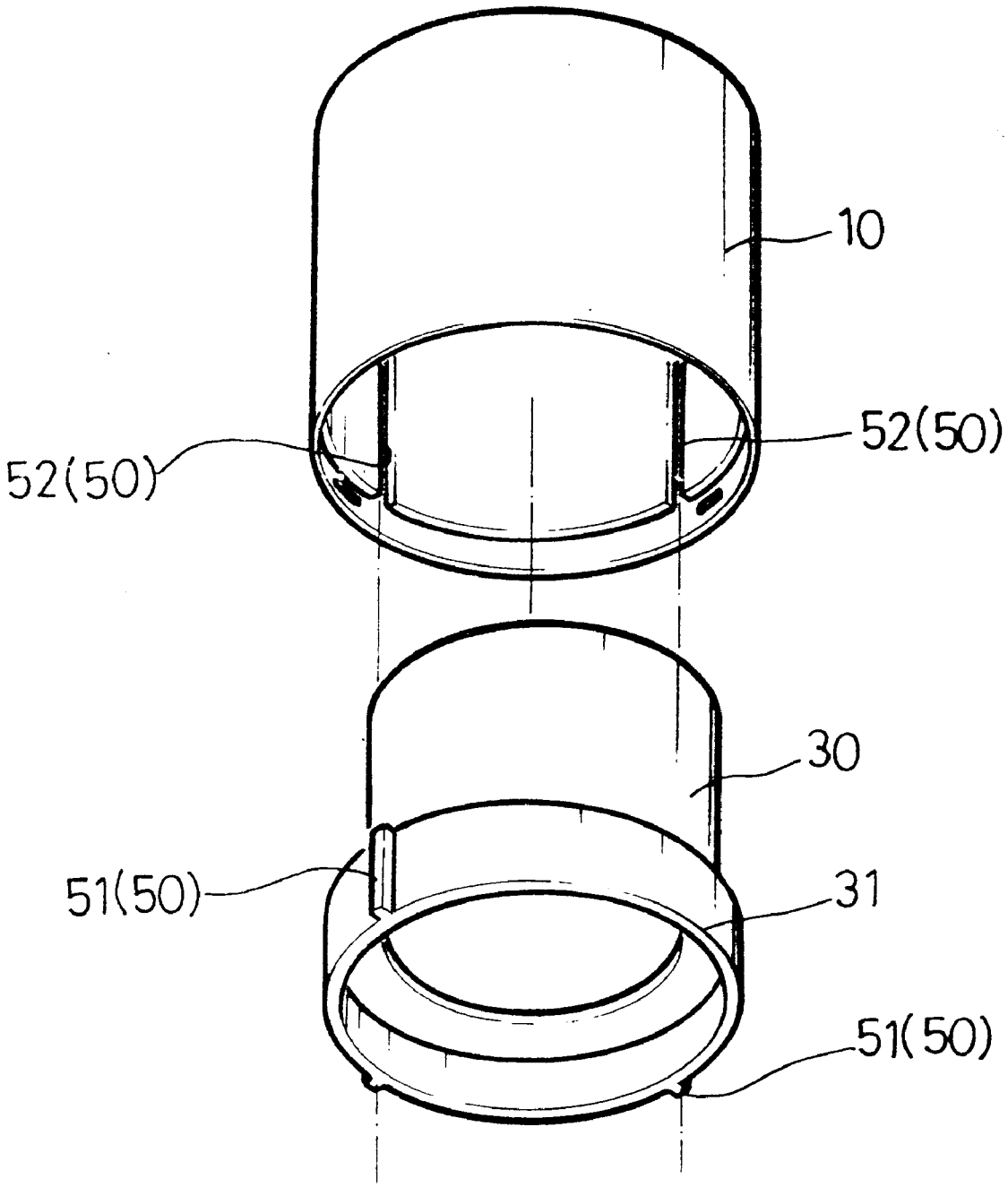

Referring to FIGS. 3 to 5, the push cap 30 for transferring pressure generated by the user's pressing action to the pressure member 20 is put into the housing 10 from the downward direction to the upward direction, and the upper portion of the push cap 30 is exposed over the housing 10. The push cap 30 has a protrusion 32 which protrudes from a lower end of the push cap 30 not to come out of the housing 10 and in contact with to the pressure member 20. In a state when pressure is not applied, the upper portion of the push cap 30 is exposed over the housing 10. When the user presses the upper portion of the push cap 30, it is pressed and slides downwardly as much as exposed. By up and down sliding action of the push cap 30, the pressure member 20 performs the pumping action.

According to the present invention, the guiding means 50 is adapted to allow smooth sliding action of the pressure member 20 under any pressure condition.

The guiding means 50 has at least two or more vertical protrusions 51 and at least two or more grooves 52. Each of the vertical protrusions 51 are inserted in each of the grooves 52, so that the push cap 30 can always slide smoothly during up and down movement of the push cap 30 in the housing 10 without inclination or twist.

FIG. 3 shows a preferred embodiment of the guiding means 50 according to the present invention.

In FIG. 3, the vertical protrusions 51 are formed on the inner wall of the housing 10 and the grooves 52 are formed in at least two or more guide members 31 protruded downwardly from the protrusion 32 of the lower end of the housing 10. The guide members 31 are abutted on the inner wall of the push cap 30. The vertical protrusions 51 of the housing 10 is slidably inserted in the grooves 52 of the push cap 30, and move up and down in the grooves 52 of the push cap 30 when the user pushes and releases the upper portion of the push cap 30. At this time, the numbers of the vertical protrusions 51 and the grooves 52 are respectively at least two or more. Preferably, it is stable that the numbers of the vertical protrusions 51 and the grooves 52 are respectively three as shown in the drawing.

FIG. 4 shows another preferred embodiment of the guiding means 50.

The guide member of FIG. 3 is sectioned, but, in FIG. 4, the guide member 31 is formed in cylindrical shape at the lower end of the push cap 30. The diameter of the guide member 31 of FIG. 4 is smaller than that of the housing 10, and an outer wall of the guide member 31 is abutted on the inner wall of the housing 10. The guide member 31 also has at least two or more grooves 52 to hold the vertical protrusions 51 of the housing 10. The guiding means 50 of FIG. 4 is identical in function and effect with that of FIG. 3.

FIG. 5 shows a further preferred embodiment of the guiding means 50.

In FIG. 5, the vertical protrusions 51 are formed on an outer surface of the guide member 31 and the grooves 52 are vertically formed in the inner wall of the housing 10. The vertical protrusions 51 of the guide member 31 are inserted in the grooves 52 of the housing 10 so as to smoothly slide up and down along the vertically formed grooves 52. However, function and effect of the guiding means 50 are identical with the guiding means 50 of FIGS. 3 and 4.

Figure 6:
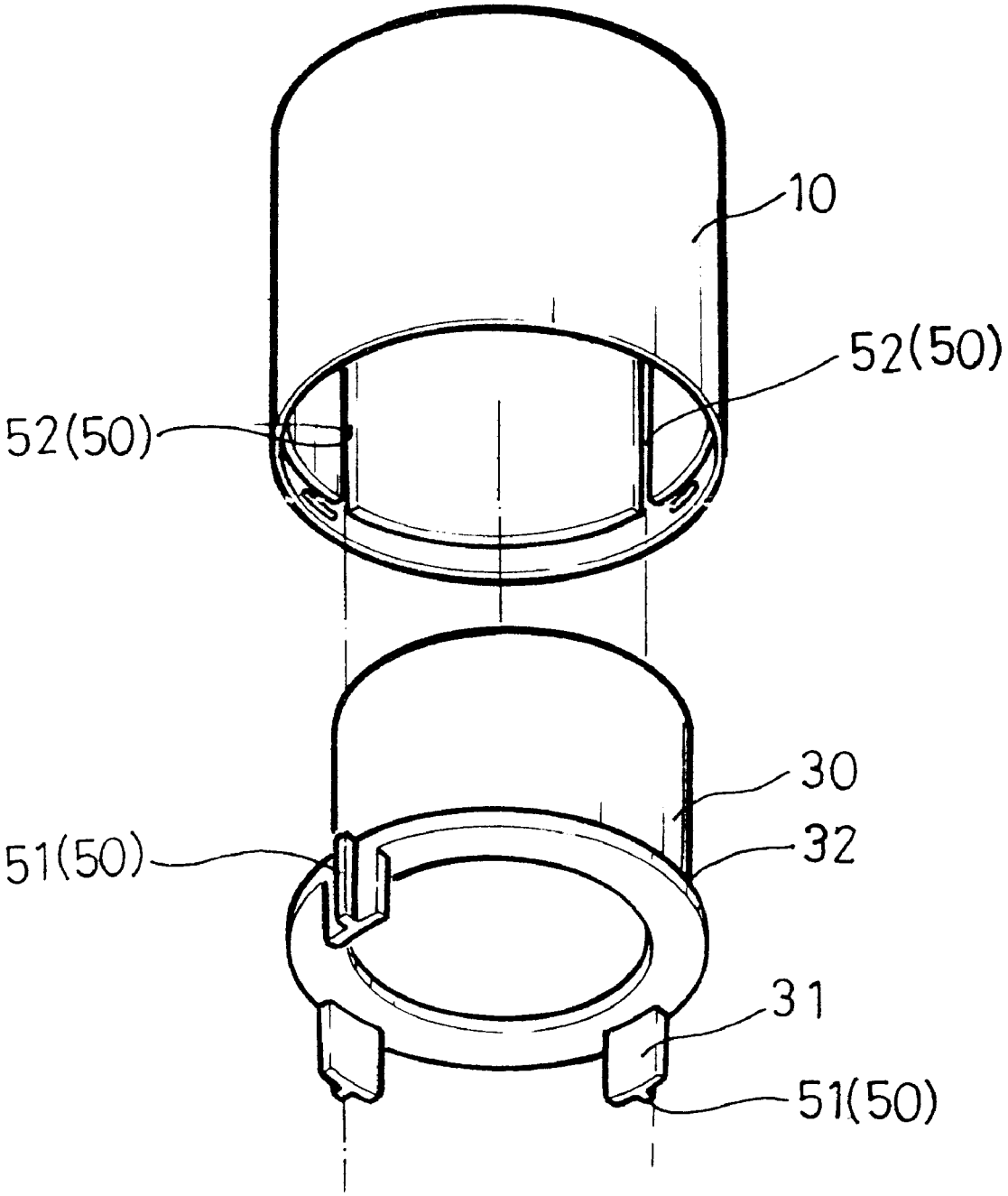
Figure 7:
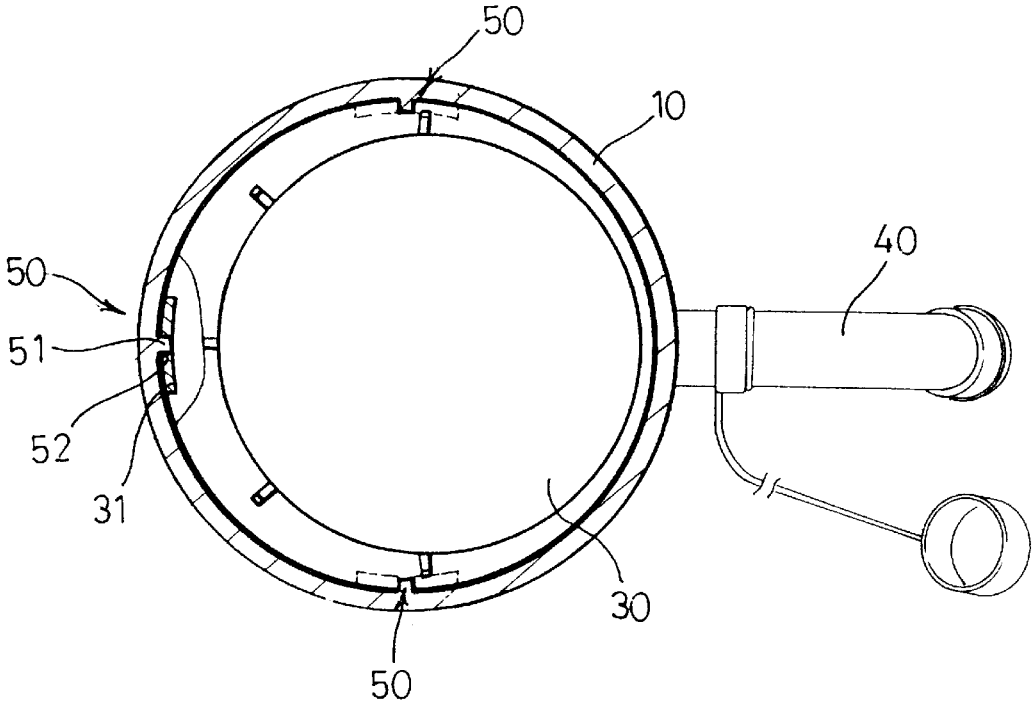
FIG. 7 is a traverse sectional view showing assembled condition of FIG. 3.
Figure 8:
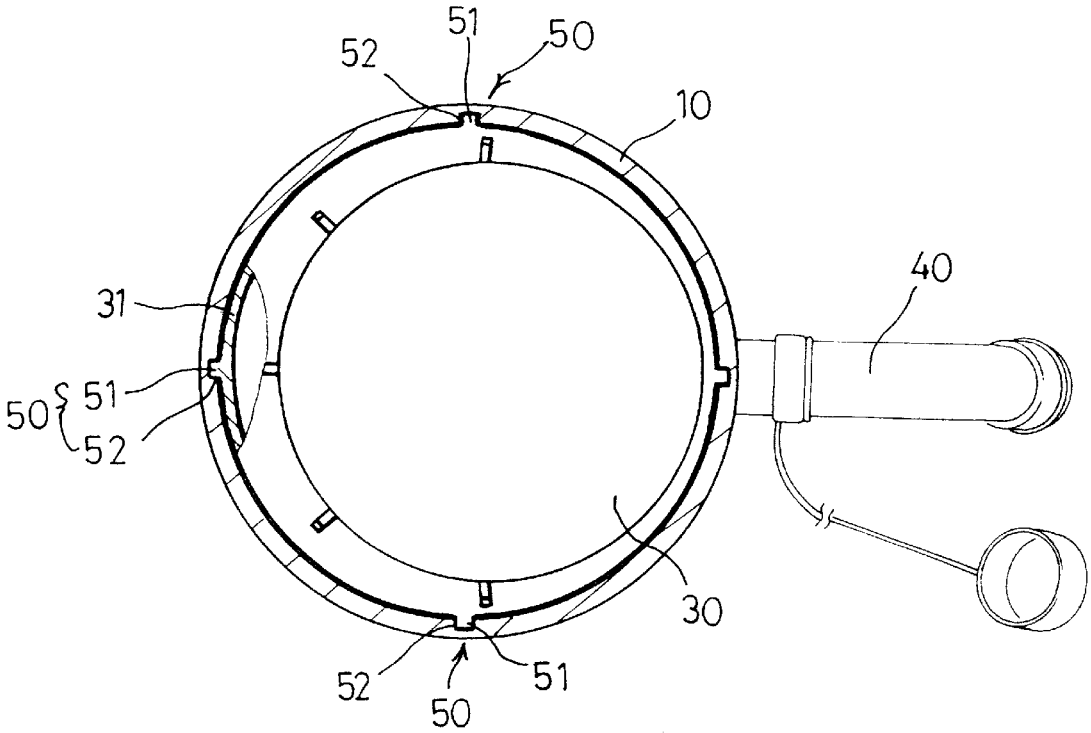
FIG. 8 is a traverse sectional view showing assembled condition of FIG. 5.

FIG. 6 shows a still further preferred embodiment of the guiding means 50.

In FIG. 6, the guide member 31 is sectioned identically with that of FIG. 3. However, the protrusions 51 are formed on the outer surface of the guide members 31, and the grooves 52 are vertically formed in the inner wall of the housing 10. This embodiment can also provide almost the same function and effect as the previously described embodiments of this invention.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A pump for spring water, comprising:

a housing sealably connected to a water container, the housing having a sealer member for sealing the connected portion between an inlet of the water container and the housing;

a bellows-type pressure member located inside the housing, the pressure member being compressed by a user's pressing action and expanded by restitutive force due to its elasticity;

a push cap having an upper portion exposed over the housing and a lower portion disposed in the housing and positioned on the pressure member, the push cap vertically sliding in the housing to compress and expand the pressure member;

a connecting pipe having an upper end mounted at the pressure member and lower end positioned in spring water in the water container, the connecting pipe drawing up spring water by sucking force generated due to a difference in the inside air pressure of the water container;

a discharge pipe for discharging spring water pumped upwardly through the connecting pipe; and guiding means for guiding vertically smooth sliding of the push cap in the housing, including a protrusion protruding from a lower end of the push cap and at least one of:

(a) at least two guiding members protruding downwardly from the protrusion of the lower end of the push cap, at least two vertical protrusions formed on an inner wall of the housing, and at least two grooves formed in the guiding members, each of the vertical protrusions being slidably inserted in each of the two grooves of the push cap and vertically sliding to vertically slide the push cap in the housing, (b) a guiding member formed in cylindrical shape at the lower end of the push cap, at least two vertical protrusions formed on an inner wall of the housing, and at least two grooves formed in the guiding member, each of the vertical protrusions being slidably inserted in each of the grooves of the push cap and vertically sliding to vertically slide the push cap in the housing, (c) a guiding member formed in cylindrical shape at the lower end of the push cap, at least two protrusions formed on an outer surface of the guide member, and at least two grooves vertically formed in the inner wall of the housing, each of the protrusions of the guide member being slidably inserted in each of the grooves of the housing and vertically sliding to vertically slide the push cap in the housing, and (d) at leas t two guiding members protruding downwardly from the protrusion of the lower end of the push cap, at least two protrusions formed on the outer surface of the guide members, and at least two grooves vertically formed in the inner wall of the housing, each of the protrusions of the guide members being slidably inserted in each of the grooves of the housing and vertically sliding to vertically slide the push cap in the housing.

2. A spring water pump according to claim 1, wherein the guide means comprises a protrusion protruded from a lower end of the push cap, at least two or more guiding members protruded downwardly from the protrusion of the lower end of the push cap, at least two or more vertical protrusions formed on an inner wall of the housing, and at least two or more grooves formed in the guiding members, each of the vertical protrusions being slidably inserted in each of the grooves of the push cap and vertically sliding to vertically slide the push cap in the housing.

3. A spring water pump according to claim 1, wherein the guide means comprises a protrusion protruded from a lower end of the push cap, a guiding member formed in cylindrical shape at the lower end of the push cap, at least two or more vertical protrusions formed on an inner wall of the housing, and at least two or more grooves formed in the guiding member, each of the vertical protrusions being slidably inserted in each of the grooves of the push cap and vertically sliding to vertically slide the push cap in the housing.

4. A spring water pump according to claim 1, wherein the guide means comprises a protrusion protruded from a lower end of the push cap, a guiding member formed in cylindrical shape at the lower end of the push cap, at least two or more protrusions formed on an outer surface of the guide member, and at least two or more grooves vertically formed in the inner wall of the housing, each of the protrusions of the guide member being slidably inserted in each of the groove s of the housing and vertically sliding to vertically slide the push cap in the housing.

5. A spring water pump according to claim 1, wherein the guide means comprises a protrusion protruded from a lower end of the push cap, at least two or more guiding members protruded downwardly from the protrusion of the lower end of the push cap, at least two or more protrusions formed on the outer surface of the guide members, and at least two or more grooves vertically formed in the inner wall of the housing, each of the protrusions of the guide members being slidably inserted in each of the grooves of the housing and vertically sliding to vertically slide the push cap in the housing.

* * * * *